United States Patent [19]

Bechem et al.

[11] Patent Number: 4,576,684

[45] Date of Patent: Mar. 18, 1986

[54] METHOD FOR THE CONTINUOUS ELECTROLYTIC DEPOSITION OF METALS

[75] Inventors: Werner Bechem, Hilchenbach; Hubertus Peters, Dortmund; Jürgen Solms, Hilchenbach; Dietrich Wolfhard, Dortmund, all of Fed. Rep. of Germany

[73] Assignee: Hoesch Aktiengesellschaft, Fed. Rep. of Germany

[21] Appl. No.: 669,444

[22] Filed: Nov. 8, 1984

[30] Foreign Application Priority Data

Dec. 6, 1983 [DE] Fed. Rep. of Germany ..... 3343978

[51] Int. Cl.[4] ..... C25D 7/06

[52] U.S. Cl. ..... 204/28

[58] Field of Search ..... 204/28, 23, 27

[56] References Cited

U.S. PATENT DOCUMENTS 2,461,556 2/1949 Lorig ..... 204/28
3,483,098 12/1969 Kramer ..... 204/28
3,483,113 12/1969 Carter ..... 204/28

FOREIGN PATENT DOCUMENTS 119031 9/1930 Austria ..... 204/208

*Primary Examiner*—T. M. Tufariello
*Attorney, Agent, or Firm*—Eric P. Schellin

[57] ABSTRACT

There is disclosed a method and a device for the continuous electrolytic deposition of metals from aqueous solutions of metallic salts onto a metal strip using a high flow speed of the electrolyte between anode and cathode in order to obtain high current densities at relatively low voltages, especially for the electrolytic coating of steel strip with non-ferrous metals, preferably with zinc. In order, particularly, in the case of a one-sided strip coating, to set and be able to regulate a very small distance between anode and cathode, these is thereby achieved low voltage losses in the electrolyte and a correspondingly lesser development of heat, while inducing a very rapid exchange of the electrolyte in the space between anode and cathode. There is obtained a high current density. Finally, not to adversely affect the industrial qualities of the strip by a very low friction of the strip to be coated, it is disclosed that the metal strip as cathode be passed along a rotating cylindrical anode and that fresh electrolytic solution be constantly introduced into the space formed between anode and cathode.

6 Claims, 3 Drawing Figures

METHOD FOR THE CONTINUOUS ELECTROLYTIC DEPOSITION OF METALS

BACKGROUND OF THE INVENTION

The invention relates to a method for the continuous electrolytic deposition of metals from aqueous solutions of metallic salts onto an elongated metal strip using a high flow speed of the electrolyte between an anode and a cathode in order to attain high current densities at relatively low voltages, especially for the electrolytic coating of a steel strip with non-ferrous metals, preferably with zinc, as well as the device for carrying out the method.

The use in electrolytic strip processing systems of soluble or non-soluble anodes which are employed in systems with a horizontal, vertical or radial strip feed in the processing part is known.

These anodes are usually adjustable and, to the extent that they are soluble anodes, they can be moved and replaced. The anodes cannot be moved relative to the direction of strip travel. The known disadvantages of such systems are caused, among other things, by the minimum space to be observed between the cathodic strip to be processed and the anodes. These spaces are necessary to prevent the strip from making contact with the anodes. The differences in traction which occur during the rolling of the strip, etc., frequently result in some corrugation of the strip edge and/or of the strip middle which in the case of horizontal and vertical processing systems necessitate strip spaces of at least approximately 10–15 mm. These spaces lead in the galvanic process to considerable voltage losses which result from the conductivity of the electrolyte used and from the space of the anode to the cathode, which necessitates considerable processing costs. In addition, the voltage losses in the electrolyte are converted into joulean heat, which necessitates greater cooling of the electrolyte than would otherwise be necessary.

The economic feasibility of electrolytic strip processing systems, e.g. the systems for coating steel strips with zinc, depends among other things on the possibility of achieving high current densities with acceptable voltages in the galvanic process. In addition to depending on the chemical composition of the electrolyte, the maximum obtainable current density depends on the thickness of the Nernst and Prandl border layers which determine the kinetics of the galvanic reaction. High flow speeds of the electrolyte are used in newer systems to reduce the thicknesses of these border layers. In the case of the specified spaces between the anode and the band to be coated, great amounts of electrolyte must be circulated to this end which necessitates the installation of appropriate pump means with a rather high consumption of energy.

The present invention is to a method of the type initially mentioned which will eliminate the disadvantages of the known methods, by means of which, particularly, when the strip is coated on only one side, a relatively very small distance between anode and cathode which can be set and regulated. Furthermore, low voltage bases in the electrolyte and a correspondingly lower development of heat are achieved. A very rapid exchange of the electrolyte in the slot between anode and cathode and a high current density are obtained and, by virtue of a very low friction on the strip to be coated, the industrial qualities of the strip are not adversely affected.

SUMMARY OF THE INVENTION

The metal strip as the cathode is moved past a rotating roller anode and fresh electrolyte solution is constantly introduced into the space formed between anode and cathode. In this way a hydrodynamically carrying flow state of the system is achieved.

The device for carrying out the method is preferably constructed in such a manner that a driven metal cylinder roller connected as anode is positioned in an electrolytic bath about which the metal strip connected as cathode which is to be processed is guided. Other preferred characteristics of the method and of the device are presented in the examples of embodiments given below.

The advantages of the method and of the device of the invention reside particularly in the fact that a very small and easily regulatable distance or space can be set between anode and cathode, which results in low voltage losses in the electrolyte and the observation of a low development of heat (joulean heat). Moreover, a very rapid electrolyte exchange with a speed of approximately 2 to approximately 500 m/sec in the space between anode and cathode brings sufficient metal ions to the cathode surface, so that high current densities are achieved for the coating of the strip. In addition, only very low strip friction is required for carrying out the method, so that the industrial qualities of the strip are not adversely affected. All these advantages result in a coating cost for the metal strip which are low in comparison to previous costs.

BRIEF DESCRIPTION OF THE DRAWINGS

The method of the invention is explained in more detail in the examples given below with reference made to FIGS. 1 through 3.

DETAILED DESCRIPTION OF THE INVENTION

Figure 1:
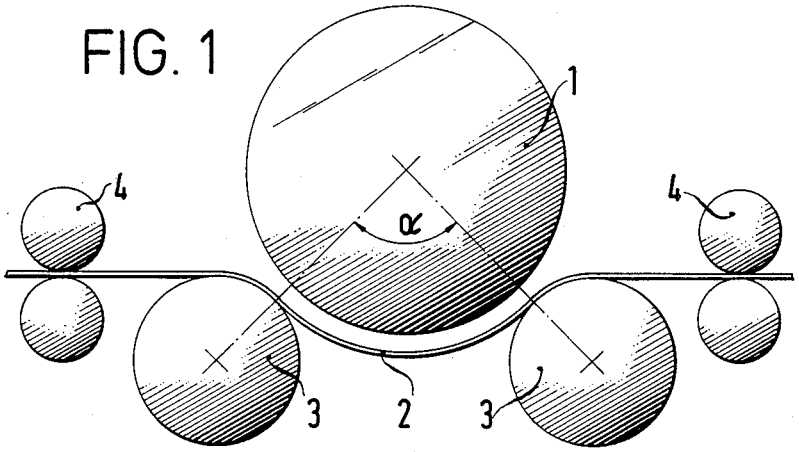
FIG. 1 depicts schematically a first embodiment in the invention.

After a customary pretreatment of a cold-rolled metal strip, in particular of steel strip 2, that is, after a cleaning, pre-deoiling and pickling; steel strip 2 is guided spatially about metal cylinder 1, which is located in an electrolytic bath and is driven by a motor (not shown). Steel strip 2, connected as cathode, is guided by driven sets of rollers (not shown) with a band traction of 2–50 $N/mm^2$, which is customary for band processing systems over looping rollers 3 with a looping angle $\alpha$ of approximately 90 degrees about metal cylinder 1 constructed as an insoluble anode.

Electrolyte is pumped or introduced into the space between metal cylinder 1 and steel band 2 by metal cylinder 1, which rotates, for example, in the same direction as steel band 2 moves, so that steel band 2 is carried by the electrolyte under the rotating surface of metal cylinder 1 without the use of additional pumping means being necessary.

The interval space between anode (metal cylinder 1) and cathode (steel band 2) of e.g. less than 2 mm can be set by a variation of the relative speed between metal cylinder 1 and steel band 2 thus providing a loop. This prevents a contact between anode and cathode. This small space makes possible high current densities with extremely low separation voltages of 0.5 to 10 volts at an adapted feed of metal ions by a precisely dosable amount of electrolyte. This, for its part, is achieved by a controlled speed of rotation of metal cylinder 1. A further possibility for regulating the space between anode and cathode is produced by the frictional traction of the band.

A varying of the relative speed can be accomplished, for example, as follows:

Given an anode diameter of 1 m and a band traction of 10 $N/mm^2$, a space of 0.936 mm with 573.4 $m^3/h$ pumped electrolyte develops at a speed of rotation of 5000 rpm's. If the speed of rotation is set at 2500 rpm's, a space of 0.493 mm at a flow amount of 115 $m^3/h$ develops.

In order to improve the separation of metal from the electrolyte onto steel strip 2, devices (not shown) for generating electric or magnetic fields are provided which accelerate the metal ions in the area of the harder layers in a controlled manner.

After steel strip 2 has been coated by the described device, a further treatment in other, similarly constructed devices is possible, depending on the required thickness of the layer of metal to be applied. After the metal coat has been applied to steel strip 2, the strip is post treated in a customary manner, that is, it is phosphated, chromated, dried, etc. as required and is finally wound in a conventional manner.

If the metal strip is to be coated on both sides, it is of course also possible to coat the side of the metal strip which does not face the rotating metal cylinder according to known, state-of-the-art methods.

In more detail, FIG. 1 shows rotating metal cylinder 1 as movable anode with metal strip 2 looped around it at the angle $\alpha$.

Electrolyte is pumped into the space between metal cylinder 1 and metal strip 2 by rotating metal cylinder 1 and a certain amount of electrolyte is circulated, depending on the surface roughness and the circumferential speed of the metal cylinder. The guidance of metal band 2 is assumed by two deflection rollers 3 which are laterally positioned under metal cylinder 1. The peripheral surfaces are preferably rubberized and are driven. The transfer of current occurs in this example onto metal strip 2 by line-connected current rollers 4 between which metal strip 2 runs. The interval between rotating metal cylinder 1 and running metal strip 2 can be set individually by the circumferential speed of metal cylinder 1.

Figure 2:
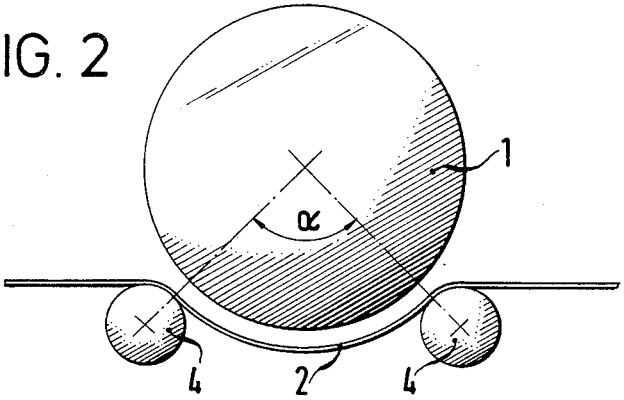
FIG. 2 depicts schematically a second embodiment of the invention.

FIG. 2 shows a use of the method of the invention similar to that of FIG. 1. As a variation of FIG. 1, in this instance, the transfer of current to metal strip 2 is accomplished by looped current rollers 4 which serve both to supply the cathode current and to assist in the formation of the loop.

Figure 3:
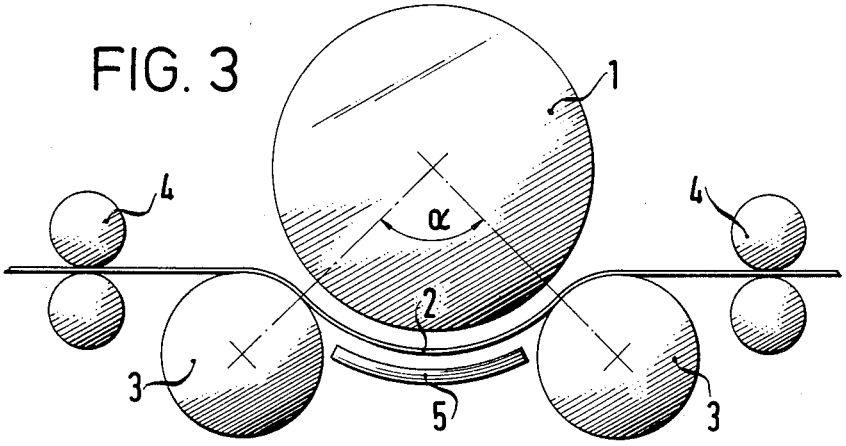
FIG. 3 depicts schematically a third embodiment of the invention.

A device in accordance with FIG. 3 there is set forth an arrangement for a two-sided electrolytic process. This embodiment includes rotating metal cylinder 1 as anode in association which metal strip 2 is passed by reflection rollers 3. The current is transferred onto metal strip 2 by electric line-connected current rollers 4. The space between metal strip 2 and metal cylinder 1 is again set by means of the circumferential speed of rotating metal cylinder 1. In order to obtain a processing on the side of metal strip 2 facing away from metal cylinder 1, it is preferable to use an insoluble anode 5. This anode 5 can also be substituted with a soluble anode.

What is claimed is:

1. Method for continuous electrolytic deposition of metals from aqueous solutions of metallic salts onto a metal strip using a high flow electrolyte exchange in the space between the anode and cathode which is sufficient to attain high current densities at low voltages comprising, moving a looped portion of a cathodic metal strip past an anodic metal cylinder, and constantly introducing fresh electrolytic solution into the space formed between the anode and cathode, by controlling the speed of rotation of said anodic metal cylinder.

2. Method according to claim 1, characterized in that the space formed between anode and cathode is set by varying the speed of rotation of the anodic metal cylinder relative to the speed of the moving cathodic strip.

3. Method according to claim 2, wherein the space formed between anode and cathode is set by controlling the traction applied to the metal strip.

4. Method according to claim 3, wherein the space is set at a value greater than zero and less than about 2 mm.

5. Method according to claim 1, wherein the electrolyte in the space between anode and cathode is subjected to the action of an electric or magnetic field.

6. Method according to claim 1, wherein the electrolyte exchange in the space between the anode and cathode is form about 2 to about 500 m/sec. and the low voltages are between about 0.5 to about 10 volts.

* * * * *